United States Patent [19]

Wu

[11] Patent Number: 4,917,245

[45] Date of Patent: Apr. 17, 1990

[54] STRUCTURE OF VACUUM FORMING PLASTIC PACKING CASE

[75] Inventor: Pauli Wu, Taipei, Taiwan

[73] Assignee: All-Prime Enterprise Corp., Taipei, Taiwan

[21] Appl. No.: 409,107

[22] Filed: Sep. 19, 1989

[51] Int. Cl.[4] ..... B65D 85/20

[52] U.S. Cl. ..... 206/471; 206/461; 206/477

[58] Field of Search ..... 206/477, 480, 471, 476, 206/461, 467, 495, 462, 463, 468, 470, 464, 465, 592, 823

[56] References Cited

U.S. PATENT DOCUMENTS

| | | | |
|---|---|---|---|
| 2,919,023 | 12/1959 | Braun | 206/477 X |
| 3,178,019 | 4/1965 | Fetzek | 206/464 X |
| 3,676,159 | 7/1972 | Fallowfield | 206/471 X |
| 3,963,123 | 6/1976 | Beal | 206/480 X |
| 4,016,972 | 4/1977 | Szamborski | 206/471 X |
| 4,619,364 | 10/1986 | Czopor, Jr. | 206/477 X |
| 4,795,029 | 1/1989 | Campbell et al. | 206/471 X |
| 4,807,747 | 2/1989 | Hadtke | 206/471 X |

*Primary Examiner*—Paul T. Sewell
*Assistant Examiner*—Jacob K. Ackun, Jr.
*Attorney, Agent, or Firm*—Fleit, Jacobson, Cohn, Price, Holman & Stern

[57] ABSTRACT

The present invention relates to an improved structure of vacuum forming plastic packing case and more particularly to the one which includes one or more inner casings set in an outer casing to firmly support the product to pack and protect the outer casing against distortion, which inner casings may also serve as containers for receiving the related accessories.

3 Claims, 2 Drawing Sheets

STRUCTURE OF VACUUM FORMING PLASTIC PACKING CASE

BACKGROUND OF THE INVENTION

Regular vacuum forming plastic packing cases which are used to pack photographic instruments, hangers, pipe fittings and etc. are generally comprised of a vacuum formed casing connected with a cover board to define a receiving space for receiving an article therein. The method of packaging may include two types: one is to take a finished product to pieces and to let the separated parts be received in a vacuum formed packing case, and the other is to assemble all component parts into a finished product and to let the finished product be received in a vacuum formed packing case. In the former, the parts tend to remove from the ordinary place, and consumers cannot see the actual shape of the product in a well assembled condition. In the latter, the product which is presented in a well assembled condition may be scratched or damaged and its component parts may break away from the assembly during transportation. The simple structure of conventional vacuum forming packing case is insufficient to protect the product packed for presentation.

It is therefore, the main object of the present invention to provide such a vacuum formed plastic packing case which includes one or more vacuum formed inner casings set between an outer casing and a bottom board to support the product to be packed, so as to let the product packed be firmly retained in the outer casing against damage.

SUMMARY OF THE INVENTION

The present invention is to provide a new utility model of vacuum formed plastic packing case which is generally comprised of an outer casing, two inner casings, two covers for the inner casing, and a bottom board. The outer casing comprises a plurality of retaining slots respectively for connection thereto of inner casings. The inner casings each have a scoop channel respectively made at the top and are received in the outer casing to support the product packed so as to let the product packed be firmly retained inside the outer casing. The inner casings each have an inner space for receiving the accessories pertaining to the product packed. The outer casing includes a channeled bottom portion formed by folding the periphery of its bottom portion inward through which the bottom board is inserted to connect with the outer casing and to further let the product packed be firmly supported.

Figure 1:
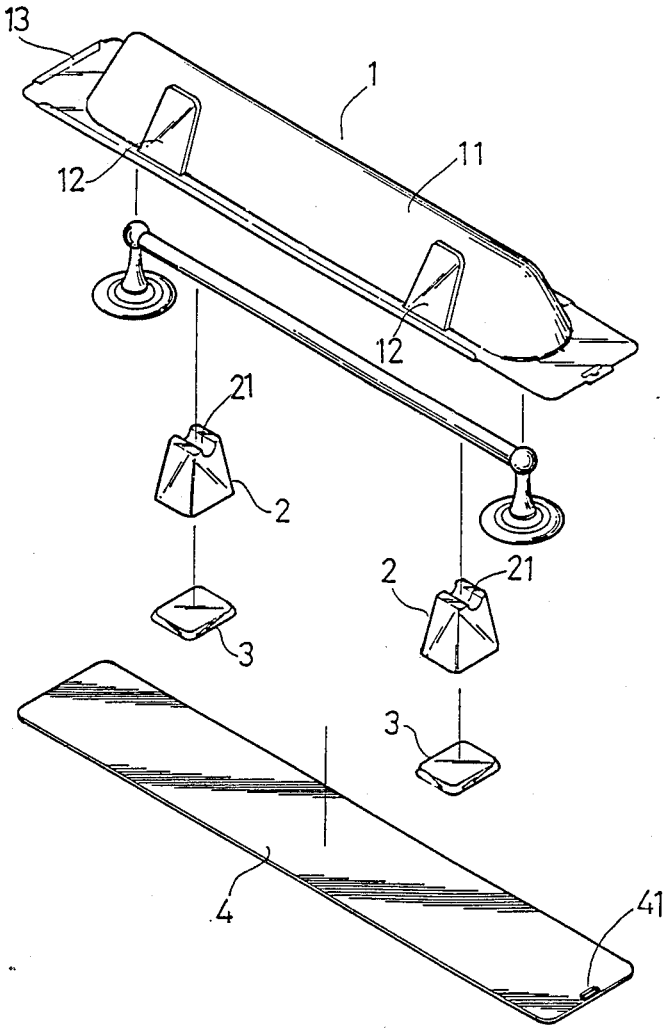
FIG. 1 is a perspective fragmentary view of a vacuum formed packing case embodying the present invention.
Figure 2:
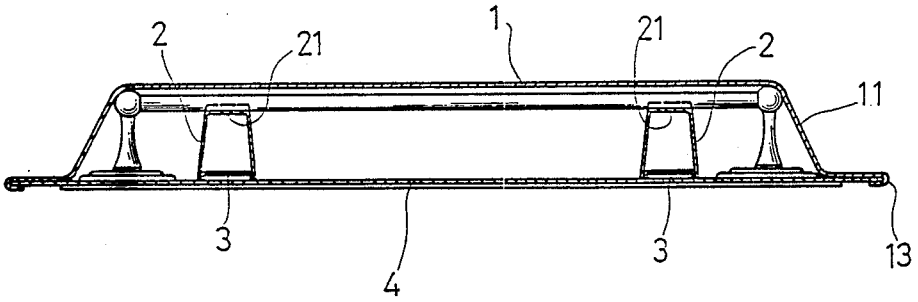
FIG. 2 is a sectional assembly view of the present invention.

DESCRIPTION OF THE DESIGNATED NUMERALS (1) . . . Outer casing
(11) . . . Slotted body
(12) . . . Retaining slot
(13) . . . Channeled bottom portion
(2) . . . Inner casing
(21) . . . Scoop channel
(3) . . . Cover for inner casing
(4) . . . Bottom board
(41) . . . Hanging hole

DETAILED DESCRIPTION OF THE PREFERRED EMBODIMENT

Referring to the attached drawings, therein illustrated is a vacuum formed plastic packing case embodying the present invention and generally comprised of an outer casing (1), a plurality of inner casings (2), inner covers (3) in number equal to the inner casing (2), and a bottom board (4). In the present embodiment, the number of inner casings is set at 2. The outer casing (1) includes a slotted body (11) for receiving the whole assembly of a finished product, having retaining slots (12) made at both ends for connection thereto of the inner casings (2) respectively. The inner casings (2) each have a scoop channel (21) at the top, which is made, according to the shape of the finished product to pack. When a finished product is received in the slotted body (11), it is supported at the scoop channels (21) of the inner casings (2) to become firmly positioned inside the outer casing (1). Further, the arrangement of the inner casings (2) inside the outer casing (1) can also support the structure of the slotted body (11) against distortion. This advantage will become more apparent when the present invention is using to pack a finished product which has an elongated or bigger body size. The outer casing (1) includes a channeled bottom portion (13) which is formed by folding the periphery of the bottom portion inward and through which the bottom board or base member (4) is inserted to support the inner casings (2) at the bottom. The bottom board (4) has a hanging hole (41) made thereon for suspension of the whole assembly. According to the present invention, the related accessories for the product to be packed may be received in the inner casings (2). When accessories are received in the inner casings (2) and the inner casings (2) are set in the outer casing (1), a cover (3) for inner casing is respectively connected to each inner casing (2) to reinforce the rigidity of the associated inner casing (2) so as to support the outer casing (1) against distortion.

I claim:

1. A vacuum formed plastic packing case, comprising:

an outer casing with a slotted body for receiving a product, said outer casing having a plurality of retaining slots formed at each of its ends, and a channeled bottom portion formed by folding a periphery of the outer casing inward;

a plurality of inner casings, each having an external channel at its top surface, made according to the shape of the product to be packed, the product to be retained in the channels of said inner casings;

a base member comprising a rigid board for insertion into said channeled bottom portion of said outer casing;

said inner casings being received in said outer casing and secured therein by fitting the inner casings into said retaining slots and by inserting said base member into said channeled bottom portion of the outer casing so that the packed product is firmly supported by said inner casings and retained within said outer casing.

2. The vacuum formed plastic packing case as set forth in claim 1, wherein said inner casings each have a hollow body and a matching cover for receiving therein accessories pertaining to the product to be packed.

3. The vacuum formed plastic packing case as set forth in claim 2, wherein said base member and said outer casing each have a hanging hole respectively made thereon, the holes being aligned and used for suspension of the whole assembly.

* * * * *